United States Patent [19]

Holowaty

[11] 4,097,245

[45] Jun. 27, 1978

[54] METHOD FOR PRODUCING CARBONACEOUS MATERIAL

[75] Inventor: Michael O. Holowaty, Crown Point, Ind.

[73] Assignee: Inland Steel Company, Chicago, Ill.

[21] Appl. No.: 662,449

[22] Filed: Mar. 1, 1976

[51] Int. Cl.[2] ..... C10L 5/16; C10L 5/40; C10B 45/02

[52] U.S. Cl. ..... 44/23; 44/10 E; 44/10 K; 201/6

[58] Field of Search ..... 44/23, 1 B, 1 R, 1 F, 44/10 K, 10 C, 10 E; 201/6, 24, 29; 208/8, 22, 39

[56] References Cited

U.S. PATENT DOCUMENTS

| | | | |
|---|---|---|---|
| 3,018,227 | 1/1962 | Baum et al. | 44/1 R |
| 3,167,494 | 1/1965 | Carwford | 208/8 |
| 3,184,293 | 5/1965 | Work et al. | 44/23 |

*Primary Examiner*—Carl F. Dees

*Attorney, Agent, or Firm*—Merriam, Marshall & Bicknell

[57] ABSTRACT

Particulized coal is subjected to a series of processing operations to produce a formed coke product. Among the operations are a single stage heating process comprising both carbonizing and calcining operations or, alternatively, a heating process in which carbonizing alone or carbonizing and calcining are conducted in separate stages. At least the carbonizing operation is conducted in the absence of extraneous gas so that the valuable by-product gases driven off from the coal during heating are unadulterated; and the carbonizing operation is conducted with gradual heating in the single stage heating process.

25 Claims, 9 Drawing Figures

COAL
11
PRE-HEATER 10
13
12
HOT GAS
15
KILN 16
17
GAS & VAPORS
CALCINER 19
COOLER 20
COOLED CHAR
18
30
TAR CONDEN-SER 21
FUEL GAS
29
22
DECANTER 23
RAW TAR
24
25
TAR CONDITIONER
GAS
26
TAR
27
BLENDER 28
31
32
BRIQUET PRESS
HEATED AIR
34
CURING OVEN 33
35
GAS
HOT GAS
41
SCHAFTER 40
42
47
GAS CLEANER 43
46
44
TAR
45
LIQUOR
FORMED COKE PRODUCT

METHOD FOR PRODUCING CARBONACEOUS MATERIAL

BACKGROUND OF THE INVENTION

The present invention relates generally to methods for producing carbonaceous materials such as formed coke, and more particularly to a method for producing a carbonaceous shape composed of (1) carbonaceous material derived from particulized coal and (2) a hydrocarbonaceous binder such as tar.

Work et al. U.S. Pat. No. 3,184,293 describes such a carbonaceous shape (hereinafter referred to as formed coke) and a method for making it. Such a method generally comprises the steps of particulizing the coal (e.g., by grinding), then drying and preheating the coal without driving off from the coal volatile vapors and gases other than moisture, and then heating the coal in a plurality of heating stages first to carbonize and then to calcine the coal. The volatile vapors and gases (i.e., the by-product gases) are driven off during these two heating stages. Next come the steps of cooling and blending wherein the carbonaceous material resulting from heating the coal is recombined with tar condensed from the volatile vapors driven off from the coal during heating. Blending is followed by the step of forming the carbonaceous material into shapes such as briquettes, followed by the steps of curing and coking the briquettes. The details of these steps are described fully in said Work et al. patent, said description being incorporated herein by reference.

One drawback of this prior art method is that the heating of the coal, following drying or preheating, must be performed in two separate stages, viz., a carbonizing stage and a calcining stage. More specifically, with most coals, in order to drive off the volatiles from the coal to the extent necessary to make formed coke having desirable properties, the coal must be heated to a temperature greater than 1200° F (649° C), usually in the range 1400°-1600° F (760°-871° C). However, in the carbonizing stage of the prior art method, the coal can be heated no higher than about 1150° F (621° C), otherwise the coal, which expands during heating, will not retract sufficiently after expansion, thereby forming a carbonaceous material of low density which is undesirable. Because of this temperature limitation during carbonizing, the resulting carbonaceous material must be subjected to a second heating step (calcining) in which the material is further heated to drive off the remaining volatiles. Depending upon the type of coal involved, retraction may occur during heating after expansion or during cooling.

Moreover, in both the carbonizing and calcining stages, the coal must be held at the temperature prevailing in the particular stage for periods of time up to one hour, thereby slowing down the processing.

Another drawback of the above-described prior art method is that the conditions accompanying the heating, conditions which must be present in order to heat the preheated coal in accordance with this prior art method, unavoidably adulterate with extraneous gases the by-product gases driven off from the coal during heating. In an unadulterated condition, these by-product gases are quite valuable, but their value lessens substantially once they have been adulterated or diluted with extraneous other gases.

SUMMARY OF THE INVENTION

The present invention relates to a method for producing a carbonaceous shape, such as formed coke of a type like that produced by the prior art method described above, but in which method (1) the heating of the already dried or preheated coal may be performed in one stage instead of two (2) the by-product gases driven off from the coal during heating are unadulterated and undiluted by extraneous gases, thereby avoiding any diminution in value of the by-product gases.

Generally, these features are accomplished by preheating the particulized coal to a temperature above that at which all the moisture is driven off from the coal but just below that at which the other volatile vapors and gases are driven off from the coal (e.g., a preheat temperature in the range of about 400°-600° F (204°-316° C). The dried, preheated coal is then carbonized and calcined by heating to a temperature at which essentialy all the volatile vapors and gases are driven off from the coal, leaving a substantially devolatilized carbonaceous material with about 5% maximum volatile content. This heating is accomplished without combusting the coal and is conducted in the absence of extraneous gas. As a result, the gases from this heating step consist essentially of the valuable by-product gases driven off from the coal undiluted by extraneous gas.

In one embodiment of the present invention, carbonizing and calcining are performed in a single continuous step, in one stage. This step comprises heating the dried, preheated coal gradually from the temperature at which it left the preheating stage (e.g., 400°-600° F) (204°-316° C) to the temperature at which devolatilization is essentially complete (e.g., 1400°-1600° F) (760°-871° C).

Gradual heating allows the coal particles to expand during heating but not to such an extent that retraction cannot occur after expansion. An example of gradual heating is about 1000° F (538° C) per hour. Faster rates are permissible so long as the calcined coal retracts from its expanded condition after expansion. If it doesn't retract, this is an indication that the heating was not gradual. Preferably, the gradual heating is accomplished in indirect heating, variations of which are described subsequently.

By employing gradual heating of the coal, from the preheating temperature up to a temperature at which virtually all the volatile gases and vapors are driven off (e.g., 1400°-1600° F) (760°-871° C), all of the heating may be conducted in a single, continuous step, in a single heating stage, and the resulting carbonaceous material will still retract from its maximum expanded condition which is obtained at a temperature in the range of about 800°-1200° F (427°-649° C). Moreover, once the coal has reached the maximum heating temperature, constituting that temperature at which essentially all the volatile vapors and gases are driven off, the calcined coal need not be held at that temperature but may be discharged from the heating stage after less than five minutes holding time and preferably immediately. However, if a residence time at the holding temperature can't be avoided, it is not harmful, a residence time in the range 5-10 minutes being one example.

In another embodiment of the invention, the dried, preheated coal may be carbonized and calcined in two separate stages. In the first stage, the preheated coal is carbonized by heating to a temperature of about 1000° F (538° C), in the absence of extraneous gas; and in this stage a great majority of the volatile vapors and gases in the coal are driven off. In a subsequent heating stage, the carbonaceous material resulting from the preceding carbonizing step is calcined by heating from 1000° F (538° C) to a temperature in the range 1400°-1600° F (760°-871° C).

In this second or calcining stage, extraneous gases may be permitted because the amount of volatile vapors and gases remaining to be driven off from the carbonaceous material after the carbonizing step is relatively small, and recovery of this small amount of gas in an unadulterated condition is relatively unimportant. Accordingly, great care need not be taken to avoid adulteration or dilution of the small amount of gas driven off during calcining. However, care should be taken that the adulterated gases driven off at this second stage are not mixed with the unadulterated gases driven off at the first stage. If mixing is permitted, it should be carefully controlled to maintain uniform heating values in the resulting gaseous mixture.

In all embodiments of the invention, the coal may be heated to the maximum temperature intended for the particular heating stage, whether carbonizing or calcining or a combined carbonizing-calcining operation, without substantial residence time at the maximum temperature (e.g., less than 5 minutes).

When two stages of heating are employed, and the preheated coal is heated, in the first stage, from a temperature in the range 400°-600° F (204°-316° C) to a temperature of about 1000° F (538° C), the temperature change is sufficiently small that gradual heating need not be employed in the first stage to obtain retraction of the expanded coal particles during heating or cooling following expansion. Similarly, in the second stage of the same two-stage heating process, when carbonaceous material is heated from a temperature in the range of about 1000° F (538° C) up to a temperature in the range 1400°-1600° F (760°-871° C), gradual heating need not be employed.

Other features and advantages are inherent in the method claimed and disclosed or will be apparent to those skilled in the art from the following detailed description in conjunction with the accompanying diagrammatic drawing.

DETAILED DESCRIPTION

Figure 1:
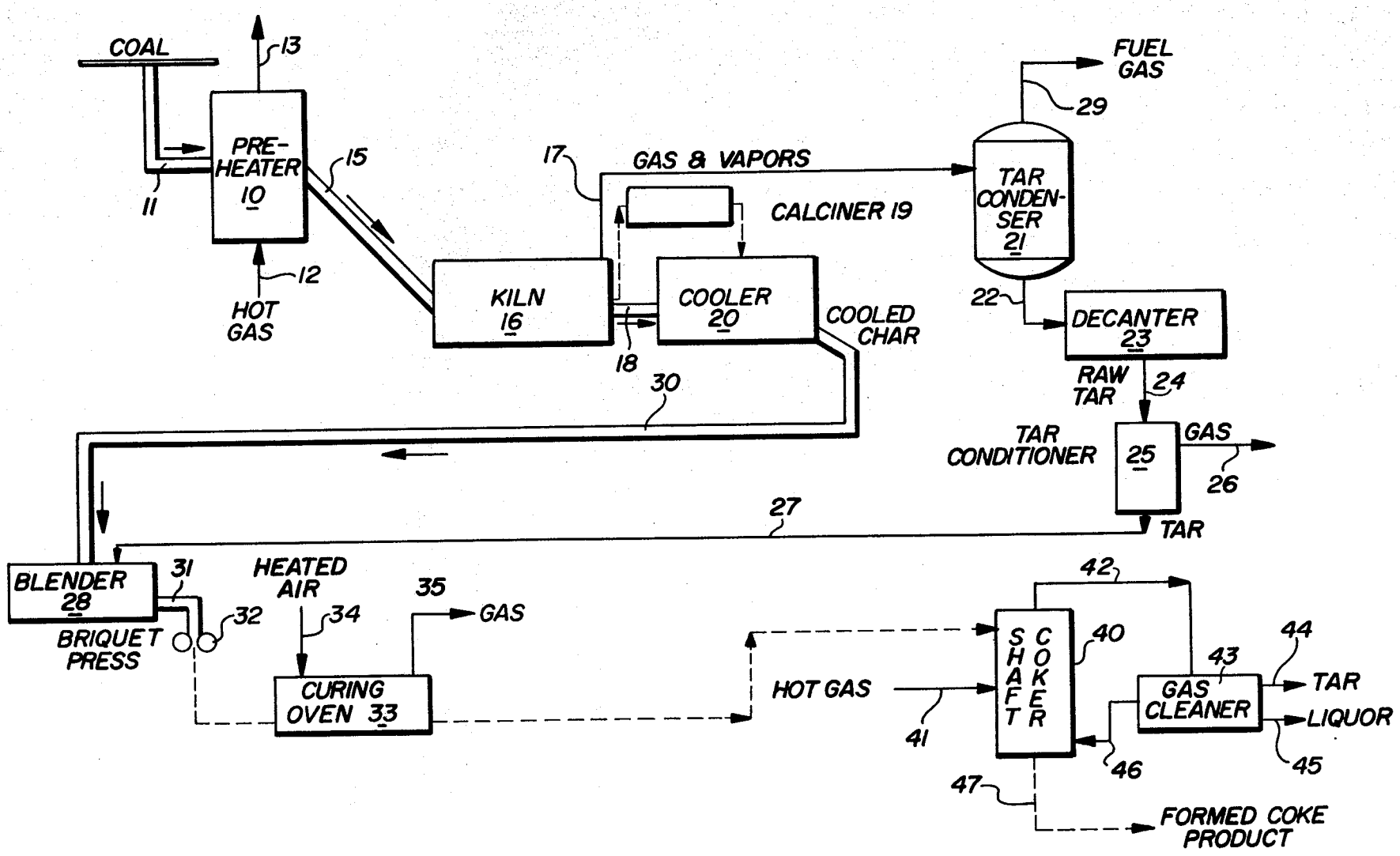
FIG. 1 is a flow diagram of an embodiment of the present invention.

Referring to FIG. 1, coal which has been particulized (e.g., by grinding) is introduced through a conduit 11 into a preheater 10 into which hot gas is introduced through a line 12. Exhaust gases from preheater 10 are removed through a line 13, and the preheated coal is carried by a conduit 15 to a kiln 16 for further heating.

Volatile vapors and gases are driven off from the coal during heating in kiln 16, and they are carried by a line 17 to a tar condenser 21. In a one-stage heating process, both carbonizing and calcining are conducted in kiln 16, and the calcined char from kiln 16 is conducted through a conduit 18 directly to a char cooler 20.

In a two-stage heating process, carbonizing is conducted in kiln 16 and calcining is conducted in a calciner 19, the carbonaceous material from kiln 16 being conducted to calciner 19 for further heating to produce a char, and the char from calciner 19 being conducted to cooler 20. The path of the carbonaceous material from kiln 16 to calciner 19 to cooler 20 is indicated by the dotted lines in FIG. 1. Gas is driven off from the carbonaceous material during the calcining process in calciner 19, but, unless these gases are free of extraneous gas, they are maintained segregated from the more valuable by-product gases driven off from the carbonaceous material in kiln 16.

With certain coals, the carbonaceous material may be cooled immediately following carbonizing, without interposing a calcining step. This will be described in greater detail below.

In tar condenser 21, a condensate containing tar is condensed from the gases and vapors entering condenser 21 through line 17. The condensate is removed from condenser 21 through a line 22 to a decanter 23, from which raw tar passes through a line 24 to a tar conditioner 25 from which conditioned tar is conducted through a line 27 to a blender 28 for mixing with cooled char conducted from cooler 20 to blender 28 through a conduit 30.

The valuable by-product gases from kiln 16, having been separated from the condensate at condenser 21, are withdrawn therefrom through a line 29. Gases separated from the raw tar at tar conditioner 25 are withdrawn therefrom through a line 26.

Returning to blender 28, the cooled char is blended there with conditioned tar, or other suitable binder, and the blend passes through a conduit 31 to a briquette press 32, from which briquettes are introduced into a curing oven 33 heated with hot air entering the curing oven through line 34. Gas is removed from curing oven 33 through a line 35.

Cured briquettes from curing oven 33 are introduced into a shaft coker 40 of conventional construction, into which hot gas is introduced through a line 41. A formed coke product is removed from shaft coker 40 at 47. The exhaust gases from the coking operation are removed from shaft coker 40 through a line 42 and introduced into a gas cleaner 43 from which tar and liquor are removed through lines 44, 45 respectively. Cleaned gas from gas cleaner 43 is recirculated to shaft coker 40 through a line 46.

Preheater 10 may be of any conventional construction, such as a rotating kiln, a vertical shaft through which descending coal is heated by rising hot gases, an elutriating shaft or a fluidized bed. Coal may be preheated with hot gas from a combustion chamber associated with the preheater, but preferably the preheater utilizes hot exhaust gases from a downstream stage of the process, the latter being less expensive, and such hot exhaust gases are usually available from one or more downstream stages.

The coal introduced into preheater 10 may be either what is kknown as a "coking" coal or a "non-coking" coal. If a coking coal is used, it must be oxidized at preheater 10 to destroy the agglutinating or fusing properties normally inherent in such coals. Non-coking coals (e.g., western or mid-western coals) do not fuse or agglutinate and thus do not have to be oxidized during the preheating operation. They need only be dried to eliminate moisture and preheated to the maximum temperature below that at which volatile vapors and gases (other than moisture) are driven off from the coal. This is normally a temperature in the range 400°-600° F (204°-316° C).

Preheating the coal at the preheating stage to as high a temperature as possible in the range 400°-600° F (204°-316° C), reduces the amount of heating required at kiln 16 where heating must be conducted without contacting the coal with hot extraneous gases. In contrast, at preheater 10, the coal may be heated directly by hot extaneous gases, including hot air, so long as combustion of the coal is avoided and the maximum temperature maintained (e.g., 400°-600° F) (204°-316° C). Direct heating with hot air, as employed at preheater 10, is more efficient than that employed at kiln 16.

Figure 2:
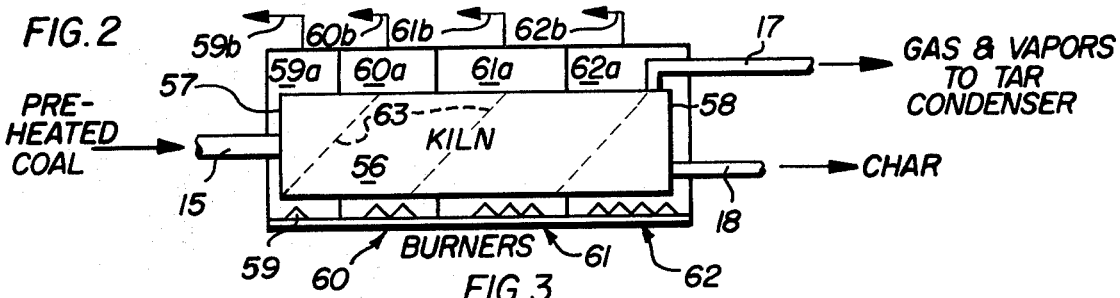
FIG. 2 illustrates a one-stage heating step in accordance with an embodiment of the present invention.

Referring now to FIG. 2, there is shown a generally horizontally disposed kiln 56 in which may be conducted either a one-stage heating process, comprising both carbonizing and calcining, or the first stage of a two-stage heating process in which only carbonizing would be conducted in kiln 56. Kiln 56 is sealed to exclude extraneous gases, such as air, and is typically composed of stainless steel.

Preheated coal entering the upstream end of kiln 56 through conduit 15 is carbonized in kiln 56 (or carbonized and calcined, as the case may be) and leaves kiln 56 as a char through conduit 18 (or as carbonized material if only a carbonizing operation is conducted in kiln 56).

As the coal progresses from upstream end 57 to downstream end 58, the coal is indirectly heated by a multiplicity of burner sets 59, 60, 61, 62 which directly heat the exterior surface of kiln 56. Each burner set 59-62 is located within a respective compartment **59*a*-62*a* each surrounding a portion of kiln 56**.

The number of burners in the sets 59-62 increases progressively in a downstream direction. Thus the first set of burners 59 may comprise only a single burner, the second set of burners 60 may comprise two burners, the third set of burners 61 may comprise three burners, and the fourth set of burners 62 may comprise four burners, etc. By progressively increasing the number of burners in the set of burners, in a downstream direction, the temperature inside kiln 56 and in compartments **59*a*-62*a* is progressively increased in a downstream direction. Thus, coal entering kiln 56 at upstream end 57 is gradually heated as it moves in a downstream direction to downstream end 58. A typical gradual heating rate is about 1000° F (538° C) per hour.**

Each compartment **59*a*-62*a* has a respective exhaust line 59*b*-62*b*. To maximize heating efficiency, the hot gases exhausted from a relatively hot downstream compartment may be introduced into an upstream compartment cooler than the gas exhausted further downstream. For example, exhaust line 62*b* may lead upstream into one of compartments 59*a*-61*a*, exhaust line 61*b* may lead upstream into one of compartments 59*a*-60*a***, etc.

Coal may be moved in a downstream direction through horizontally disposed kiln 56 using conventional apparatus. For example, kiln 56 may be in the shape of a horizontally disposed cylinder having spiral screw vanes 63 extending inwardly from the interior periphery of the cylinder which is rotated about its axis. As the kiln rotates, the flights or vanes of the screw advance the material undergoing heating through the kiln at a controlled rate. Alternatively, cylindrical kiln 56 may be slightly downwardly inclined, in a downstream direction, and rotated about its axis to effect the desired movement.

Coal enters upstream end 57 of kiln 56, from the preheater, at a preheated temperature in the range 400°-600° F (204°-316° C). In a one-stage heating process, char leaves downstream end 58 of kiln 56 at a temperature in the range 1400°-1600° F (760°-871° C). In a two-stage heating process, wherein only the first stage of heating is conducted in kiln 56, carbonized material would leave the downstream end 58 of kiln 56 at a temperature of about 1000° F (538° C).

Because the coal in kiln 56 is indirectly heated through the walls of kiln 56, the volatile vapors and gases driven off from the coal in kiln 56 are not adulterated with the gaseous products of combustion from burners 59-62. As previously noted, other extraneous gases are excluded from the interior of the kiln. Accordingly, the volatile vapors and gases driven off from the coal in kiln 56, and exiting through line 17, remain essentially unadulterated with extraneous gases.

Figure 3:
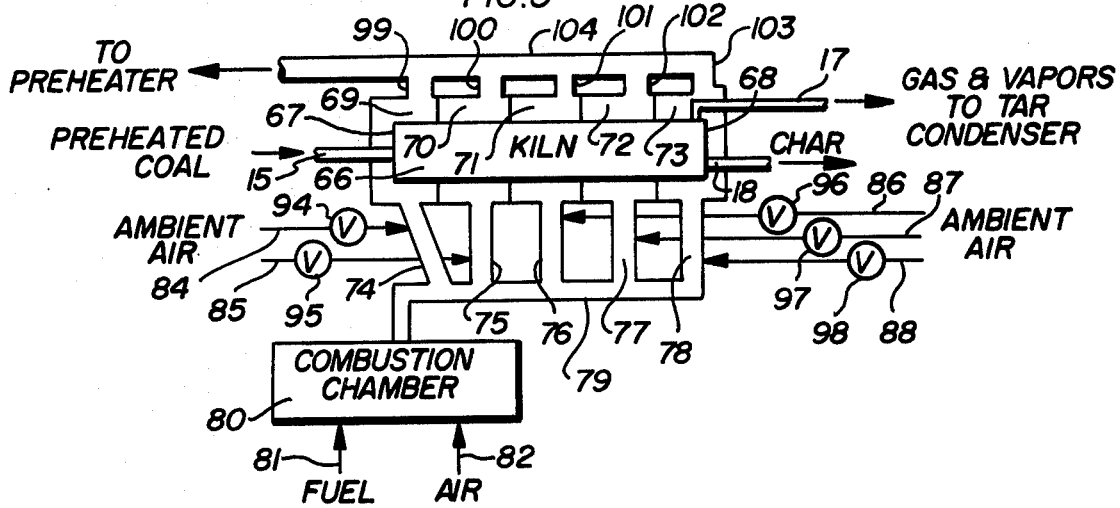
FIG. 3 illustrates a one-stage heating step in accordance with another embodiment of the present invention.

Refering to FIG. 3, there is illustrated another embodiment of a kiln 66 in which preheated coal may be carbonized and calcined (in a one-stage heating process) or carbonized alone (as the sole stage or the first stage of a two-stage heating process). Preheated coal enters kiln 66 from conduit 15, and the coal is heated indirectly and gradually as it moves from upstream kiln end 67 to downstream kiln end 68 from where it is withdrawn through conduit 18.

Heating of kiln 66 is accomplished by a series of heating compartments 69, 70, 71, 72, 73 surrounding kiln 66 and into which heated gas is introduced through respective branch conduits 74, 75, 76, 77, 78 all communicating with a main conduit 79 leading from a combustion chamber 80 into which fuel and air are introduced for combustion through lines 81, 82, respectively.

The product of combustion from combustion chamber 80 is mixed in branch conduits 74-78 with ambient air entering the branch conduits through respective ambient air lines 84-88 each having respective control valves 94-98 for controlling the amount of cool, ambient air mixed with the hot product of combustion to thereby control the temperature of the resulting gas mixture in branch conduits 74-78 and in the respective heating commpartments 69-73 with which the branch conduits communicate. The temperature is controlled so that the heating compartments become progressively hotter in a downstream direction from compartment 69 to compartment 73, thereby progressively increasing the temperature of kiln 66 from upstream end 67 to downstream end 68 and gradually heating the coal as it moved downstream through kiln 66.

After heating kiln 66, the gases are exhausted from heating compartments 69-73 through respective exhaust branch conduits 99-103 communicating with an exhaust main 104 which preferably conducts these exhaust gases to preheater 10 where they are used to preheat the coal.

Coal may be conducted in a downstream direction through kiln 66 in any conventional manner, as described above in connection with kiln 56, for example.

Kiln 66 is sealed to exclude extraneous gases, such as air or the heating gases passing through the heating compartments. The kiln may be composed of stainless steel, for example.

Volatile vapors and gases given off from the coal in kiln 66 during the carbonizing and calcining operations are removed through line 17. Because there is no mixing of extraneous gases with the volatile vapors and gases driven off from the coal in kiln 66, the volatile vapors and gases in conduit 17 are essentially unadulterated, and the gases have a high heating value.

In the embodiments of both FIGS. 2 and 3, where both carbonizing and calcining are conducted in a single-stage heating kiln 56 or 66, no subsequent heating is performed after the kiln, prior to the briquetting step at briquette press 32.

Figure 4:
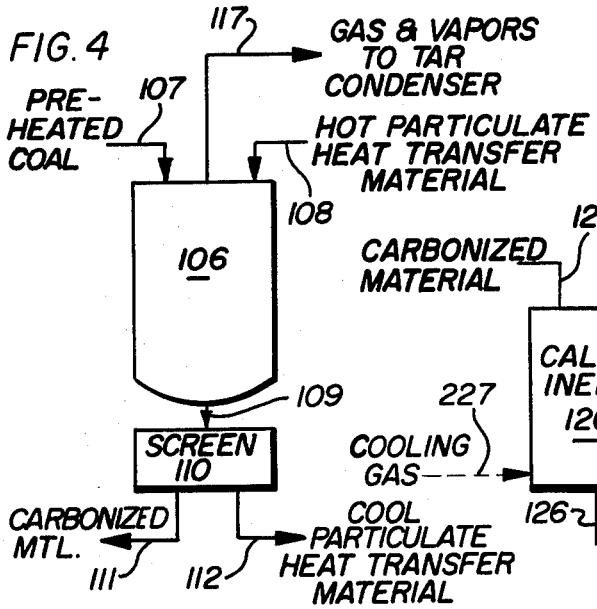
FIG. 4 illustrates the first stage in a two-stage heating process in accordance with an embodiment of the present invention.

FIG. 4 illustrates a vertical heating shaft 106 in which a carbonizing operation may be conducted as the first stage in a two-stage heating operation. Crawford U.S. Pat. No. 3,265,608.

Preheated coal is introduced into the top of vertical shaft 106 through a line 107. The preheated coal is mixed, at the top of shaft 106, with hot particulate heat transfer material introduced into the top of shaft 106 through a line 108. The heat transfer material may be in the form of stainless steel or ceramic balls heated to a temperature exceeding that required to carbonize the coal. As the coal and the hot particulate heat transfer material descend in shaft 106, heat is transferred from the latter material to the coal, carbonizing the coal. The mixture of carbonized material and cooled, particulate heat transfer material are removed from the bottom of shaft 106 at 109 and subjected to a screening operation at 110 to separate the carbonized material from the cooled particulate heat transfer material. The carbonized material separated at screen 110 is withdrawn along a conduit 111, and cooled particulate heat transfer material is withdrawn along a conduit 112 for reheating and recirculation to the top of vertical shaft 106.

The carbonized material leaving shaft 106 is at a temperature of about 1000° F (538° C) maximum, and the particulate heat transfer material entering shaft 106 is at a temperature of, e.g., about 1400°-1600° F (760°-871° C).

Shaft 106 is sealed to exclude extraneous gases, such as air. Volatile vapors and gases driven off from the coal during the carbonizing operation rise in shaft 106 and are removed through line 117. These volatile vapors and gases are unmixed with and unadulterated by extraneous gases which were excluded from vertical shaft 106 during the heating operation.

As previously noted, preheated coal enters vertical shaft 106 at a temperature as high as possible in the range 400°-600° F (204°-316° C), and the coal is heated in the shaft 106 to a maximum temperature of about 1000° F (538° C). The increase in temperature the coal undergoes during carbonizing in shaft 106 (e.g., an increase of 400°-600° F) (204°-316° C) is relatively small compared to the increase in temperature the coal undergoes in a single-stage heating operation combining carbonizing and calcining (e.g., an increase of 1000°-1200° F) (538°-649° C). Because the temperature rise during carbonizing in shaft 106 is relatively small, gradual heating need not be employed, and the adverse effects of abrupt heating, namely expansion of the coal particles without substantial retraction thereafter, will not occur.

Accordingly, direct heating of the preheated coal at the top of shaft 106 by direct contact with hot, particulate heat transfer material having a temperature exceeding that to which the coal is to be heated may be properly employed, so long as the temperature of the heat transfer material is not too much higher than that of the preheated coal. Thus, mixing preheated coal (at a temperature in the range of 400°-600° F) (204°-316° C) with particulate heat transfer material having a temperature of about 1400° F (760° C) will not produce the aforementioned adverse effects upon the coal. On the other hand, if the hot, particulate heat transfer material were at an excessively high temperature, upon mixing of such material with the preheated coal the aforementioned adverse effects could occur.

In a two-stage heating operation, the carbonized material coming from the carbonizing operation is subjected to a second stage of heating to calcine the carbonized material. Calcining may be accomplished with indirect heating utilizing kilns such as 56 and 66 in FIGS. 2 and 3 respectively or with direct heating utilizing a vertical shaft such as 106 in FIG. 4. In all of those methods, extraneous gases are excluded from mixing with the volatile vapors and gases driven off from the coal during the heating operation.

Figure 5:
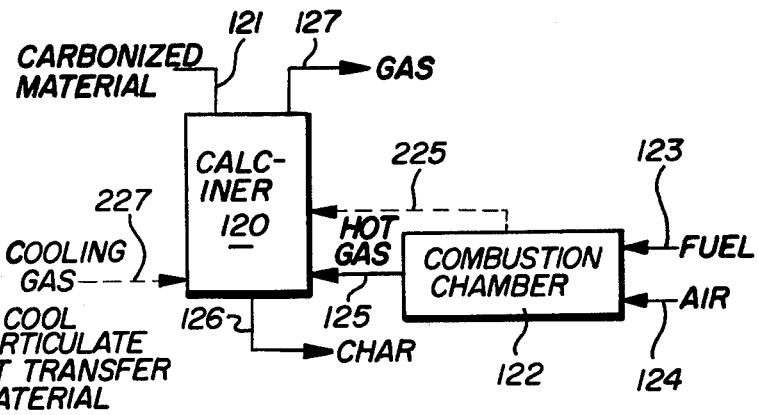
FIG. 5 illustrates the second stage in a two-stage heating process in accordance with an embodiment of the present invention.

Alternatively, the calcining stage of a two-stage heating operation may utilize direct heating with extraneous gases, and such an embodiment is illustrated in FIG. 5. Direct heating with extraneous gases is permissible because most of the valuable by-product gases were driven off from the coal during the carbonizing stage. The amount of valuable by-product gases remaining to be driven off in the calcining stage of a two-stage heating operation is relatively so small that their recovery in an unadulterated condition is not an important factor.

Referring to FIG. 5, carbonized material is introduced through a line 121 into the top of a vertically disposed calcining chamber 120. The carbonized material descends through the calcining chamber 120 and is heated by rising hot gases, flowing in countercurrent relation through the descending carbonized material. The hot gases are introduced into the bottom of calcining chamber 120, at a temperature of about 2000° F (1093° C), through a line 125 leading from a combustion chamber 122 into which fuel and air are introduced through respective lines 123, 124. The hot gases from combustion chamber 122 are sufficiently non-oxidizing to avoid combusting the coal.

The char resulting from the calcining operation is removed from the bottom of vertically disposed calcining chamber 120 through a line 126, and the rising gases, after heating the descending carbonized material, are removed from calcining chamber 120 through an exhaust line 127.

In an alternative embodiment, the hot gas from combustion chamber 122 is introduced through a line 225 into the middle of vertically disposed calcining chamber 120, and a non-oxidizing cooling gas (e.g., $N_2$ or CO) is introduced through a line 227 into the bottom of calcining chamber 120. In this alternative embodiment, the entire calcining operation would have to be conducted as the carbonized material descends from the top of calcining chamber 120 to the level to which hot gas is introduced through line 225, and this may require an increased vertical dimension for calcining chamber 120. As the char descends below the level at which hot gas is introduced through line 225, it is cooled by the rising cooling gas introduced through line 227 into the bottom of the calcining chamber, and the char removed through line 126 in this alternative embodiment has already undergone some cooling from the maximum temperature to which it was heated during the calcining operation.

In certain coals, following carbonizing (i.e., heating to a maximum temperature no greater than about 1000° F) (538° C), the coal has been sufficiently devolatilized (e.g., only 7–15% of the volatiles remain in the carbonized material) and the carbonized material retracts sufficiently following the expansion it undergoes during carbonizing, as to make formed coke having the desired properties without first undergoing additional heating before briquetting. When these properties are present following carbonizing, the carbonized material may be immediately cooled, preparatory to briquetting without interposing a calcining step. One example of a coal which, upon carbonizing, provides such properties is Colowyo coal mined from a deposit in Moffat County, Colorado in the northwestern corner of that state.

Figure 6:
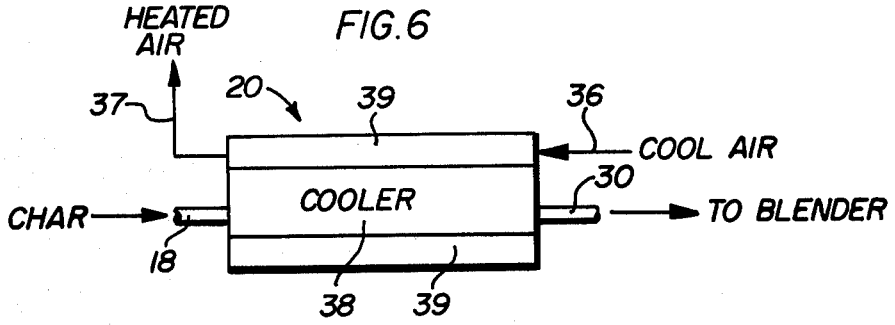
FIG. 6 illustrates a cooling step in accordance with an embodiment of the present invention.

Before the calcined char (or carbonized material, as the case may be) can be briquetted, it must be cooled to a temperature no greater than about 200° F (93° C), and this is accomplished in cooler 20 (FIG. 6) having an inner compartment 38 into which the char is introduced through a conduit 18 and an outer cooling jacket 39 into which cool air is introduced through a line 36. The char moves in a downstream direction through inner compartment 38, and the cooling air flows in an upstream direction through outer jacket 39 cooling the inner compartment and the char therein. The cooling air is heated as it flows upstream through jacket 39, and the heated air is removed through an exhaust line 37 which may communicate with line 12 (FIG. 1) for feeding the heated air into preheater 10. The cooled char leaves cooler 20 through conduit 30 which conducts it to blender 28 (FIG. 1).

Char may be advanced in a downstream direction through cooler 20 by providing cooler 20 in the form of a rotating drum slightly inclined in a downstream direction. The cool air introduced into cooler 20 may be ambient air or any gas having a relatively cool temperature low enough to reduce the temperature of the char to about 200° F (93° C). The heated air removed through exhaust conduit 37 can be used at preheater 10 or at some other stage in the process requiring heated air, such as curing oven 33 (FIG. 1). The heated air from line 37 may also be introduced into one of the combustion chambers 122 (FIG. 5) or 80 (FIG. 3) for combustion with the fuel.

Referring again to FIG. 1, the volatile vapors and gases from the carbonizing stage (in a two-stage heating operation) or from the carbonizing and calcining stage (in a single stage heating operation) flow through line 17 to a tar condenser 21 where the gases are separated from the volatile vapors and withdrawn through a line 29. The gases withdrawn through line 29 are unadulterated by extraneous gases and have a heating value in the range 800–1200 BTU per standard cubic foot of gas, or greater. More specifically, gas from the carbonizing stage in a two-stage heating operation would be in the range 800–1000 BTU per standard cubic foot of gas whereas the unadulterated gas from a carbonizing and calcining operation in a single stage heating operation would be in the range 1000–1200 BTU per standard cubic foot of gas, or higher.

Tyical examples of the composition of a gas from the carbonizing stage in a two-stage heating operation, after separation from the volatile vapors, are set forth below, with the ingredients expressed as Mol. %.

TABLE I

| Ingredient | Example A | Example B |
|---|---|---|
| $H_2$ | 12.34 | 19.08 |
| CO | 15.76 | 12.69 |
| $CO_2$ | 21.48 | 17.19 |
| $H_2S$ | 0.60 | 0.14 |
| $CH_4$ | 35.38 | 35.78 |
| $C_2H_6$ | 5.77 | 4.37 |
| $C_2H_4$ | — | 1.25 |
| $C_3H_8$ | 1.37 | 0.89 |
| $C_3H_6$ | 1.59 | 0.93 |
| $C_4H_{10}$ | 1.53 | 0.96 |
| $C_5H_{12}$ | 0.98 | 4.03 |
| $C_6H_{14}$ | 1.40 | 1.98 |
| $C_7H_{16}$ | 1.15 | 0.75 |
| $C_8H_{18}$ | 0.66 | — |
| Mol. Weight | 27.64 | 25.63 |
| Gross Heating Value BTU/SCF | 887 | 935 |

The $H_2$ came from the cracking of $CH_4$, and the oxygen in the CO and $CO_2$ came from the coal itself, as there were no extraneous gases mixed with the gases driven off from the coal.

The unadulterated gas recovered from a single stage heating operation involving both carbonizing and calcining would be richer in hydrocarbons than the unadulterated gas recovered from the carbonizing stage of a two-stage heating operation as was the gas of Table I.

The unadulterated gas recovered from the heating operation and withdrawn through line 29 can be used as a chemical feed stock from which can be separated, for example, ethane, ethylene, butane, butylene, propane, propylene, etc. Alternatively, the unadulterated gas may be used as fuel, e.g., at combustion chambers 80 (FIG. 3) or 122 (FIG. 5) or elsewhere, as the unadulterated gas has a high fuel value.

Figure 8:
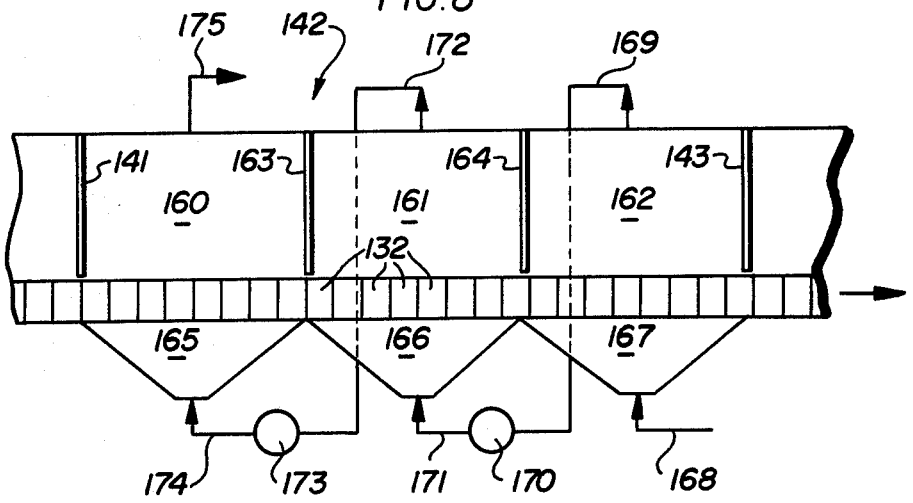
FIG. 8 illustrates the coking step of FIG. 7.
Figure 9:
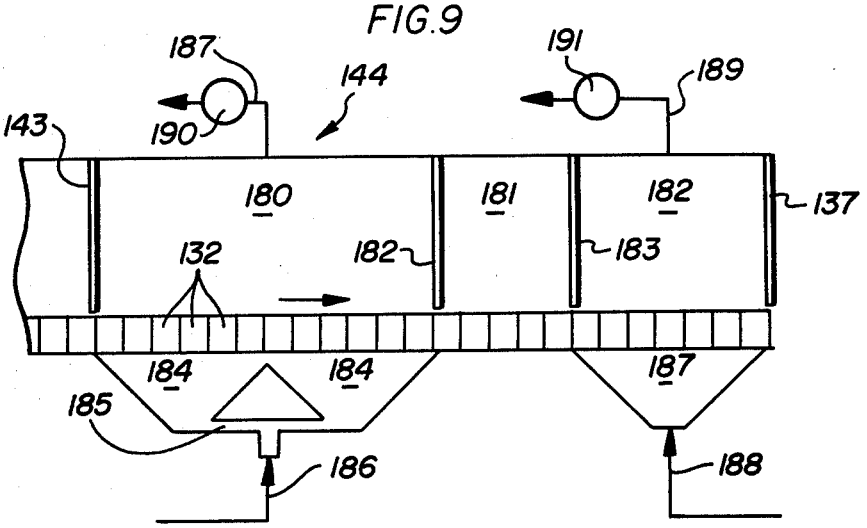
FIG. 9 illustrates the cooling step of FIG. 7.

Downstream of cooler 20 the processing seps may be practiced in accordance with the teachings of Work et al. U.S. Pat. No. 3,184,293, to the extent that they are not inconsistent with the objectives described above. Alternatively, the curing and coking steps may be combined in one continuous operation, as illustrated in FIGS. 7–9.

Figure 7:
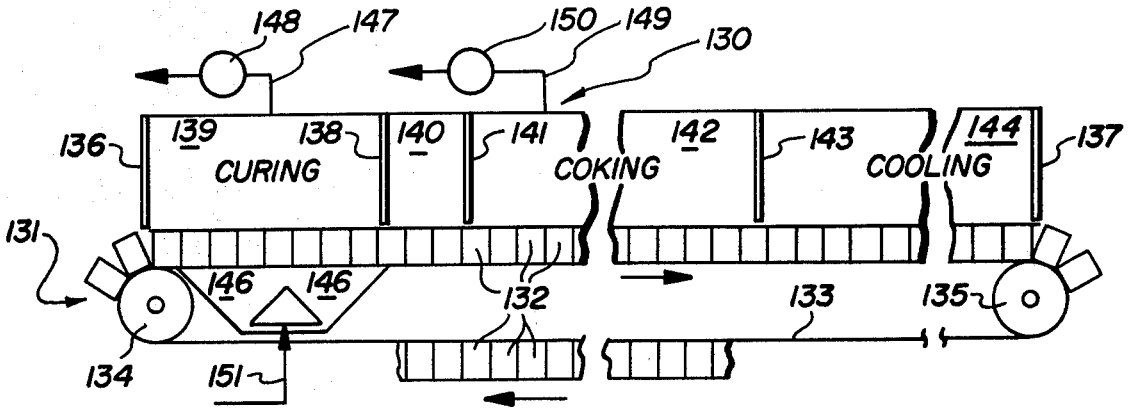
FIG. 7 illustrates continuous curing, coking and cooling steps in accordance with an embodiment of the present invention.

Referring to FIG. 7, indicated generally at 130 is a continuous enclosure through which briquettes are conducted on a moving grate 131 comprising a plurality of pallets 132 driven along a continuous track 133 extending around end wheels 134, 135. Enclosure 130 comprises end walls 135, 137 and baffles 138, 141 and 143. Baffle 138 separates a curing zone 139 from a blocking zone 140 separated by baffle 141 from a coking zone 142 separated by baffle 143 from a cooling zone 144.

Briqettes in pallets 132 are heated in curing zone 139 by hot air (about 500° F) (260° C) from hot air distributing boxes 146 fed by a hot air line 151, and exhaust gases from curing zone 139 are removed through an exhaust line 147 connected to an exhaust fan 148.

Briquettes in coking zone 141 are heated by hot non-oxidizing gases (e.g., $N_2$, CO, $H_2$), and blocking zone 140 helps prevent the oxidizing gases in curing zone 139 from crossing over to coking zone 142, and vice versa. More specifically, hot exhaust gases from coking zone 142 are withdrawn through an exhaust line 149 connected to an exhaust fan 150. Curing zone exhaust fan 148 and coking zone exhaust fan 150 are controlled to provide substantially identical pressures in zones 139 and 142 adjacent blocking zone 140 which is a quiet or dead zone with no exhaust connection. By equalizing the pressures in zones 139 and 141 and providing a blocking zone 140 between them, crossover of gases from one of zones 139, 141 to the other is prevented.

Blocking zone baffles 138 and 141 extend downwardly to within about two inches from the top of the pile of coke briquettes in pallets 132, and may be hydraulically raised or lowered in response to signals from sensors (not shown) which sense the level of the coke briquettes on pallets 132.

Referring to FIG. 8, coking zone 142 may comprise a plurality of compartments 160, 161, 162 divided by intermediate baffles 163, 164. Briquettes in pallets 132 are heated in compartments 160–162 by hot gas inroduced through gas distributing boxes 165–167 respectively.

Coking zone 142 may be heated using a multi-pass system, one embodiment of which is illustrated in FIG. 8. Hot non-oxidizing gases (e.g., 1500°–1600° F) (816°–871° C) are initially introduced through a line 168 into gas distributing box 167 for compartment 162 which, together with its contents, are heated by the introduced gas.

Exhaust gases from compartment 162 are withdrawn through a line 169 connected to a fan 170 and are fed through a line 171 into gas distributing box 166 for compartment 161 which, together with its contents, is heated by the introduced gas. Exhaust gases are withdrawn from compartment 161 by a line 172 connected to a fan 173 and are fed through a line 174 into the gas distributing box 165 of compartment 160 which, together with its contents is heated by the introduced gas. Exhaust gases are withdrawn from compartment 160 through a line 175.

The gas withdrawn from a given compartment 160–162 is cooler than the gas inroduced into that same compartment because the gas gave up some of its heat to heat the compartment and its contents. The gas introduced into a given compartment is hotter than the briquettes entering the compartment. The briquettes are heated as they move in a downstream direction, entering compartment 160 at a briquette temperature of about 500° F (260° C) and leaving compartment 162 at about 1500° F (816° C). The hot gas is cooled as it passes through the compartments in an upstream direction, entering compartment 162 at a gas temperature of about 1500°–1600° F (816°–871° C) and leaving compartment 160 at a temperature of about 500°–600° F (260°–316° C).

In an alternative embodiment exhaust gases from the last downstream compartment 162 may be introduced directly into both upstream compartments 160, 161.

Referring to FIG. 9 cooling zone 144 may comprise a first cooling compartment 180 separated from a second cooling compartment 182 by a temperature equalizing and blocking compartment 181 defined by upstream and downstream baffles 182, 183 respectively. Coke briquettes in pallets 132 enter first cooling compartment 180 at a temperature of about 1500° F (816° C) and are cooled therein to a temperature of about 500°–600° F (260°–316° C) by gases at the latter temperature introduced into gas distributing boxes 184, 184 connected by a main 185 fed by a line 186 which may be connected to the exhaust line 175 from the furthest upstream coking compartment 160 (FIG. 8). Heated exhaust gases (about 1000° F) (538° C) are withdrawn from first cooling compartment 180 through a line 187 by a fan 190; and these exhaust gases may be further heated to 1500°–1600° F (816°–871° C) before recycling to the last coking compartment 162 through line 168 (FIG. 8).

Briquettes leaving first cooling compartment 180 may have a surface temperature in the range 500°–600° F (260°–316° C) and a higher interior temperature. In blocking compartment 181, the temperature of an individual briquette is allowed to equalize throughout to a temperature in the range 500°–600° F (260°–316° C).

Further cooling of the briquettes occurs in second cooling compartment 182 which the briquettes enter at a temperature of about 500°–600° F (260°–316° C) and in which the briquettes are cooled to about 200° F (93° C) by ambient air introduced into a gas distributing box 187 through a line 188. Hot air at a temperature of about 500° F (260° C) is withdrawn from compartment 182 through a line 189 by a fan 191. Line 189 may connect with hot air-introducing line 151 at curing zone 139 (FIG. 7). Exhaust fans 187 and 191 are controlled to equalize the pressure in cooling compartments 180, 183, and these exhaust fans cooperate with blocking zone 181 to prevent crossover of gases from one of compartments 139, 141 to the other. This keeps oxidizing gases (e.g., air) in compartment 182 and out of compartment 180 where the briquettes enter at a temperature of about 1500° F (816° C), a temperature at which oxidizing gases are undesirable. The crossover preventing operation performed at blocking compartment 181 in the cooling zone is similar to that performed at blocking zone 140 between the curing and coking zones 139, 141 (FIG. 7).

As an alternative embodiment, second cooling compartment 182 may be divided into a plurality of subcompartments by baffles, like baffles 163, 164 which subdivide coking zone 142, and cooled with a multi-pass system like that used in connection with coking zone 142 (FIG. 8).

The foregoing detailed description has been given for clearness of understanding only, and no unnecessary limitations should be understood therefrom, as modifications will be obvious to those skilled in the art.

What is claimed is:

1. In a method for producing a carbonaceous shape composed of carbonaceous material derived from particulized coal and a hydrocarbonaceous binder, wherein said method includes briquetting and coking steps, the additional steps comprising:

preheating said particulized coal in a preheating stage to a preheating temperature which drives off moisture without driving off volatile vapors and gases from said coal;

heating the preheated coal, in a single heating stage, from said preheating temperature to a temperature above 1400° F (760° C), to drive off volatile vapors and gases from said coal, without combusting said coal, and to produce a carbonaceous material;

and capturing the gases driven off during said heating step;

said heating step being conducted prior to said briquetting and coking step;

said heating step being conducted in the absence of extraneous gas so that said captured gases consist essentially of the volatile vapors and gases driven off from said coal undiluted with extraneous gas;

said method comprising a plurality of steps, including said above-recited steps, which cooperate to avoid producing a carbonaceous material having a size and shape characteristic of expansion without retraction.

2. In a method as recited in claim 1 wherein said heating step comprises:

heating said preheated, particulized coal gradually from said preheating temperature up to a temperature in the range of about 1400°-1600° F (760°-871° C).

3. In a method as recited in claim 1 wherein said heating step comprises:

heating said preheated, particulized coal gradually, from said preheating temperature to said temperature above 1400° F (760° C), whereby the particulized coal undergoes expansion followed by retraction.

4. In a method as recited in claim 1 and comprising:

removing said carbonaceous material from said heating stage;

and briquetting said carbonaceous material with a hydrocarbonaceous binder after its removal from said single heating stage;

no subsequent heating being performed after said heating step and prior to said briquetting step.

5. In a method as recited in claim 1 wherein said preheated coal is heated gradually to a maximum temperture constituting that temperature, in the range of about 1400°-1600° F (760°-871° C), at which essentially all of said volatile vapors and gases are driven off from the coal, without substantial residence time at said maximum temperature.

6. In a method as recited in claim 5 wherein the residence time at said maximum temperature is less than five minutes.

7. In a method as recited in claim 2 wherein said heating step comprises:

advancing said preheated coal along a predetermined path in a closed heat-transferring vessel having an interior isolated from the ambient atmosphere;

heating said vessel on the outside, along said predetermined path, to indirectly heat said preheated coal inside the vessel;

and controlling the heat applied to the outside of said vessel so as to gradually increase the temperature of said path in a downstream direction.

8. In a method as recited in claim 1 wherein:

said preheating step comprises preheating said particulized coal to a temperature above 400° F (204° C) by directly contacting said coal with heated extraneous gas;

and separating said preheated coal from said extraneous gas before said heating of said preheated coal to produce said carbonaceous material.

9. In a method as recited in claim 8 wherein:

said carbonaceous material is briquetted following said heating step;

and said heated extraneous gas is derived from a processing step downstream of said preheating step and upstream of said briquetting step.

10. In a method as recited in claim 1 wherein said coal is fusible and said preheating step comprises oxidizing said coal to destroy said fusibility.

11. In a method as recited in claim 1 and comprising the further steps of:

briquetting said carbonaceous material;

curing said briquettes in a curing zone;

and coking said cured briquettes in a coking zone downstream of said curing zone and in communication therewith;

said curing and coking steps being conducted as a single continuous operation without cooling between the curing and coking steps.

12. In a method as recited in claim 11 wherein:

said curing step comprises introducing hot air into said curing zone;

said coking step comprises introducing hot non-oxidizing gas in said coking zone;

said method comprising preventing said hot air in said curing zone from entering said coking zone by interposing a blocking zone between said curing and coking zones and equalizing the gas pressure in said curing and coking zones.

13. In a method as recited in claim 12 wherein said coking step comprises:

moving said briquettes downstream through a series of coking sub-zones;

introducing hot, non-oxidizing gas from an external source into the coking sub-zone furthest downstream;

and exhausting gas from said coking sub-zone furthest downstream and introducing said gas into a coking sub-zone upstream of the sub-zone from which said gas was exhausted.

14. In a method as recited in claim 11 and comprising:

cooling said briquettes after said coking step in a cooling zone communicating with said coking zone without previous cooling following said coking step.

15. In a method as recited in claim 14 and comprising:

moving said briquettes downstream through a series of coking sub-zones;

introducing hot, non-oxidizing gas from an external source into the coking sub-zone furthest downstream;

exhausting gas from said sub-zone furthest downstream and introducing said gas into a coking sub-zone upstream of the sub-zone from which said gas was exhausted;

and exhausting non-oxidizing gas from said coking sub-zone furthest upstream and introducing said gas into the furthest upstream portion of said cooling zone.

16. In a method as recited in claim 14 wherein said cooling step comprises:

cooling said briquettes in an upstream cooling sub-zone with non-oxidizing gas;

further cooling said briquettes in a downstream cooling sub-zone with ambient air;

and preventing said ambient air in said downstream cooling sub-zone from entering said upstream cooling sub-zone by interposing a blocking sub-zone between said upstream and downstream cooling sub-zones and equalizing the gas pressure in said upstream and downstream cooling sub-zones.

17. In a method as recited in claim 16 wherein said non-oxidizing cooling gas used in said upstream cooling sub-zone is obtained from the upstream end of said coking zone.

18. In a method for producing a carbonaceous shape composed of carbonaceous material derived from particulized coal and a hydrocarbonaceous binder, the steps comprising:

processing particulized coal to produce a substantially devolatilized carbonaceous material;

briquetting said carbonaceous material;
curing said briquettes in a curing zone;
and coking said cured briquettes in a coking zone downstream of said curing zone and in communication therewith;
said curing and coking steps being conducted as a single continuous operation without cooling between the curing and coking steps;
said curing step comprising introducing hot air into said curing zone;
said coking step comprising introducing hot nonoxidizing gas in said coking zone;
said method comprising preventing said hot air in said curing zone from entering said coking zone by interposing a blocking zone between said curing and coking zones and equalizing the gas pressure in said curing and coking zones.

19. In a method as recited in claim 18 wherein said coking step comprises:
moving said briquettes downstream through a series of coking sub-zones;
introducing hot, non-oxidizing gas from an external source into the coking sub-zone furthest downstream;
and exhausting gas from said coking sub-zone furthest downstream and introducing said gas into a coking sub-zone upstream of the sub-zone from which said gas was exhausted.

20. In a method for producing a carbonaceous shape composed of carbonaceous material derived from particulized coal and a hydrocarbonaceous binder, the steps comprising:
processing particulized coal to produce a substantially devolatilized carbonaceous material;
briquetting said carbonaceous material;
curing said briquettes in a curing zone;
and coking said cured briquettes in a coking zone downstream of said curing zone and in communication therewith;
said curing and coking steps being conducted as a single continuous operation without cooling between the curing and coking steps;
and cooling said briquettes after said coking step in a cooling zone communicating with said coking zone without previous cooling following said coking step;
said cooling step comprising a plurality of cooling sub-steps each conducted in a separate, discrete cooling sub-zone.

21. In a method for producing a carbonaceous shape composed of carbonaceous material derived from particulized coal and a hydrocarbonaceous binder, the steps comprising:
processing particulized coal to produce a substantially devolatilized carbonaceous material;
briquetting said carbonaceous material;
curing said briquettes in a curing zone;
coking said cured briquettes in a coking zone downstream of said curing zone and in communication therewith;
cooling said briquettes after said coking step in a cooling zone communicating with said coking zone without previous cooling following said coking step;
said coking step comprising moving said briquettes downstream through a series of coking sub-zones;
introducing hot, non-oxidizing gas from an external source into the coking sub-zone furthest downstream;
exhausting gas from said sub-zone furthest downstream and introducing said gas into a coking sub-zone upstream of the sub-zone from which said gas was exhausted;
and exhausting non-oxidizing gas from said coking sub-zone furthest upstream and introducing said gas into the furthest upstream portion of said cooling zone.

22. In a method as recited in claim 20 wherein said cooling step comprises:
cooling said briquettes in an upstream cooling sub-zone with non-oxidizing gas;
further cooling said briquettes in a downstream cooling sub-zone with ambient air;
and preventing said ambient air in said downstream cooling sub-zone from entering said upstream cooling sub-zone by interposing a blocking sub-zone between said upstream and downstream cooling sub-zones and equalizing the gas pressure in said upstream and downstream cooling sub-zones.

23. In a method as recited in claim 22 wherein said non-oxidizing cooling gas used in said upstream cooling sub-zone is obtained from the upstream end of said coking zone.

24. In a method as recited in claim 1 wherein said heating step comprises indirectly heating said preheated coal.

25. In a method as recited in claim 1 wherein said heating step comprises:
carbonizing and calcining said preheated coal in a single, continuous, uninterrupted operation.

* * * * *